United States Patent [19]

Malik et al.

[11] Patent Number: 4,678,595

[45] Date of Patent: Jul. 7, 1987

[54] CARPET SHAMPOO OR UPHOLSTERY CLEANING COMPOSITION

[75] Inventors: Arshad H. Malik; Allen D. Urfer; Robert S. McDaniel; Donald L. Johnson, all of Decatur, Ill.

[73] Assignee: A. E. Staley Manufacturing Company, Decatur, Ill.

[21] Appl. No.: 769,631

[22] Filed: Aug. 26, 1985

[51] Int. Cl.[4] ..... C11D 1/83; C11D 3/37

[52] U.S. Cl. ..... 252/174.17; 134/4; 252/174.23; 252/174.24; 252/546; 252/550; 252/551; 252/555; 252/557; 252/DIG. 2; 252/DIG. 14; 252/173

[58] Field of Search ..... 252/173, 174.17, 174.23, 252/174.24, DIG. 2, DIG. 14; 134/4

[56] References Cited

U.S. PATENT DOCUMENTS

| | | | |
|---|---|---|---|
| 3,485,762 | 12/1969 | Gower et al. | 252/174.24 |
| 3,723,323 | 3/1973 | Morgan et al. | 252/174.24 |
| 4,002,571 | 1/1977 | Anderle et al. | 252/90 |
| 4,145,303 | 3/1979 | Loudas | 252/156 |
| 4,203,859 | 5/1980 | Kirn et al. | 252/174.23 |
| 4,483,779 | 11/1984 | Llenado et al. | 252/135 |
| 4,536,318 | 8/1985 | Cook et al. | 252/174.17 |
| 4,543,205 | 9/1985 | Contamin | 252/546 |

FOREIGN PATENT DOCUMENTS 2139243 11/1984 United Kingdom .

OTHER PUBLICATIONS

"Recent Trends in Carpet Shampoo", Laurence R. Smith, *Household and Personal Products Industry,* Oct. 1976, pp. 37, 38, 172.

"Mechanism and Inhibition of Carpet Resoiling," William A. Kirn, Soap, Cosmetics and Chemical Specialties, Sep. 1980, pp. 39, 40, 42, 44.

*Primary Examiner*—Prince E. Willis

*Attorney, Agent, or Firm*—James B. Guffey; Michael F. Campbell; J. Daniel Wood

[57] ABSTRACT

Aqueous liquid carpet and upholstery shampoo compositions are provided which comprise a glycoside surfactant, a normally solid, water soluble or water dispersible polymer component and water. In a particularly preferred embodiment, the surfactant ingredient employed consists essentially of one or more glycoside surfactants and utilizes a polymer-containing shampoo modifier system of the type disclosed in U.S. Pat. No. 4,203,859.

The indicated compositions are utilized in the cleaning of soiled carpet or upholstery by applying said composition to the soiled carpeting or upholstery; permitting same to dry and harden thereon and thereafter removing at least a portion of the resulting soil-containing polymer residue by vacuuming.

5 Claims, No Drawings

CARPET SHAMPOO OR UPHOLSTERY CLEANING COMPOSITION

BACKGROUND OF THE INVENTION

The present invention pertains generally to aqueous detergent compositions suitable for use as carpet shampoos and in upholstery cleaning applications. In particular, said invention pertains to those types of carpet shampoo/upholstery cleaning compositions which are designed for, or adapted to, being applied to the soiled carpet or upholstery fabric of interest; dried to form a non-tacky friable film or powdery residue upon said carpet or upholstery fabric, said film or powder having trapped therein (or otherwise associated therewith) at least a portion of the soil, dirt, debris, etc. which is desired to be removed from said carpet or upholstery fabric; and removed by vacuuming away the resulting soil-containing friable film or powdery residue.

Carpet shampoo compositions adapted to or suitable for use in the above-stated fashion are known in the art. See, for example, U.S. Pat. No. 4,203,859 to Kirn et al. (issued May 20, 1980); "Recent Trends in Carpet Shampoos" by Laurence R. Smith, *Household & Personal Products Industry,* October 1976 (pages 37, 38 and 72); and "Mechanism and Inhibition of Carpet Resoiling" by William A. Kirn, *Soap/Cosmetics/Chemical Specialties,* September 1980 (pages 39, 40, 42 and 44).

Carpet and upholstery shampoo formulations known to date (and as described in the foregoing references) have employed anionic surfactants (particularly, water soluble salts of fatty alkyl sulfates or of sulfated ethoxylated fatty alcohols) as the primary shampoo surfactant ingredient and have apparently also been known to utilize, as foam builder or stabilizer ingredients, materials such as sulfosuccinates, sarcosinates and amine oxides as well as alkyl amides, alkanol amides, amphoteric cycloimidines or imidazolines.

Compositions of the type described above appear to have gained commercial acceptance and to generally function in an acceptable fashion for their stated purpose. Nonetheless, there continues to be a need or demand for new and different shampoo formulations (and/or for alternative ingredients or components suitable for use in same) in order to provide carpet/upholstery shampoo manufacturers enhanced flexibility and freedom of choice in terms of the character, availability, cost, etc. of components or ingredients suitable for incorporation into such carpet/upholstery shampoo products. In short, there is a continuing demand for new and improved and/or more economical carpet/upholstery shampoo products or formulations.

SUMMARY OF THE INVENTION

It has now been discovered that glycoside surfactants, when formulated with certain other ingredients as hereinafter discussed, are quite suitable and effective for use in carpet shampoo and upholstery cleaning compositions. Thus, there is provided in accordance with the present invention an aqueous liquid detergent composition which is suitable for use in carpet shampooing and upholstery cleaning applications and which comprises:

a. from about 1 to about 50 parts by weight of a surfactant ingredient comprising, on a surfactant ingredient weight basis, at least about 5 weight percent of a glycoside surfactant;

b. from about 1 to about 50 parts by weight of a normally solid water soluble or water dispersible addition polymer; and c. from about 50 to about 98 parts by weight water.

It has additionally been discovered that in those instances wherein the glycoside surfactant is employed as the predominant (e.g., greater than 70 weight percent of the total surfactant content) or sole surfactant ingredient, notable reduction in post-cleaning resoiling propensity can be achieved by utilizing polymeric shampoo modifiers of the sort described in U.S. Pat. No. 4,203,859 to Kirn et al in favor of other potential water soluble or water dispersible addition polymer ingredients. Accordingly, this latter embodiment is characterized by the use of the indicated Kirn et al type of shampoo modifier (i.e., as the water soluble or dispersible addition polymer ingredient herein) in conjunction with a surfactant ingredient which consists predominantly or essentially of one or more of the aforementioned glycoside surfactants. For the sake of brevity within the present application, the discussion and description of the Kirn et al shampoo modifier as set forth in their U.S. Pat. No. 4,203,859 is hereby incorporated by reference.

DETAILED DESCRIPTION OF THE INVENTION

Glycoside surfactants suitable for use in the practice of the present invention include those of the formula:

$$RO(R^1O)_y(Z)_xA$$

wherein R is a monovalent organic radial (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to about 18 and more preferably from about 9 to about 13) carbon atoms; O is an oxygen atom; $R^1$ is a divalent hydrocarbon radical containing from 2 to about 4 carbon atoms such as ethylene, propylene or butylene (most preferably the unit $(R^1O)_y$ represents repeating units of ethylene oxide, propylene oxide and/or random or block combinations thereof); y is a number having an average value of from 0 to about 12: Z represents a moiety derived from a reducing saccharide containing 5 or 6 carbon atoms (most preferably a glucose unit); and x is a number having an average value of from 1 to about 10 (preferably from 1 to about 7 and most preferably from 1 to about 5).

Glycoside surfactants of the sort mentioned above are discussed in U.S. Pat. No. 4,483,779 to Llenado et al (issued Nov. 20, 1984) the discussion and description of which is hereby incorporated by reference.

Glycoside surfactants suitable for use herein also include those of the Formula A above in which one or more of the normally free (i.e, unreacted) hydroxyl groups of the saccharide moiety, Z, have been alkoxylated (preferably, ethoxylated or propoxylated) so as to attach one or more pendant alkoxy or poly (alkoxy) groups in place thereof. In such event, the amount of alkylene oxide (e.g., ethylene oxide, propylene oxide, etc.) employed will typically range from about 1 to about 20 (preferably from about 1 to about 10 and most preferably about 1 to about 4) moles thereof per mole of saccharide moiety within the Formula A glycoside material.

In glycosides of the Formula A above, the $RO(R^1O)_y$ group is generally bonded or attached to the number 1 carbon atom of the saccharide moiety, Z. Accordingly, the free hydroxyls available for alkoxylation are typically those in the number 2, 3, 4 and 6 positions in 6-carbon atom saccharides and those in the number 2, 3 and 4 positions in 5-carbon atom saccharide species. Typically, the number 2 position hydroxyls in 5-carbon saccharides, and the number 2 and 6 position hydroxyls in 6-carbon saccharides, are substantially more reactive or susceptible to alkoxylation than those in the number 3 and 4 positions. Accordingly, alkoxylation will usually occur in the former locations in preference to the latter. Examples of the indicated alkoxylated glycoside materials, and of methodology suitable for the preparations of same, are described in U.S. patent application Ser. No. 704,828 filed Feb. 22, 1985 by Roth et al.

Glycoside surfactants especially preferred for use herein include those of the Formula A above wherein R is an alkyl or alkenyl group containing from about 8 to about 18 carbon atoms; y is zero, Z is derived from glucose; and x has an average value of from 1 to about 7.

In certain preferred embodiments hereof the surfactant ingredient employed will consist essentially of one or more of the above-described glycoside surfactants while in other preferred embodiments said glycoside surfactant will be employed in conjunction with an anionic surfactant. In this latter embodiment, the glycoside surfactant will generally constitute from about 5 to about 70 weight percent of said surfactant ingredient and the resoiling resistance of the resulting formulation can be notably improved by the inclusion of an anionic surfactant in an amount generally constituting from about 30 to about 95 weight percent of the total weight of said surfactant ingredient.

Anionic surfactant components suitable for use in the above-stated fashion include long chain (e.g., $C_8$–$C_{20}$) alpha olefin sulfonates; long chain alkyl sarcosinates; long chain alkyl sulfosuccinates, long chain alkyl polyethoxy sulfates; higher alkyl (e.g., $C_8$–$C_{20}$)sulfates; and the like.

Typically, the above-described surfactant ingredient will be employed in an amount ranging from about 1 to about 50 parts by weight per 100 parts by weight of the carpet or upholstery shampoo composition of interest. Preferably, from about 5 to about 25 parts by weight of said surfactant ingredient will be employed per 100 parts by weight of the resulting shampoo composition.

The shampoo compositions hereof also contain (per 100 parts by weight of said shampoo composition) from about 1 to about 50 (preferably from about 5 to about 25) parts by weight of a normally solid and water soluble or water dispersible addition polymer. (By the term "normally solid" as used herein, it is meant that the polymer to which said term refers has a glass transition temperature in excess of normal room temperature, e.g., about 25° C., such that said polymer, when free of solvent and plasticizer materials, takes the form of a non-tacky solid substance.)

Suitable normally solid, water dispersible or water soluble polymer materials for use herein include, generally, the special butyl acrylate/styrene (optional)-/methyl methacrylate/methacrylic, acrylic and/or itaconic acid copolymers disclosed in U.S. Pat. No. 4,203,859; styrene/maleic anhydride copolymers; partially esterified styrene/maleic anhydride copolymers (including neutralized salts thereof); carboxylated acrylic polymers in general; and the like.

As a general rule, the compositions hereof will employ the above-discussed surfactant ingredient and the addition polymer component in a dry solids weight ratio of from about 1:99 to 90:10. Preferably the surfactant to polymer ratio will be from about 20:80 to about 70:30 (most preferably from about 60:40 to about 40:60).

As has been noted above, one particularly preferred embodiment hereof involves the use of the low molecular weight acrylic addition polymers disclosed in U.S. Pat. No. 4,203,859. In those instances where that particular polymer is employed, it is also preferred that the polymer component (or the carpet or upholstery shampoo containing same) further comprise at least 0.8 equivalents of polyvalent metal ion per equivalent of carboxyl groups in the addition polymer; ammonia or a volatile amine in an amount effective to solubilize the addition polymer; and $CO_3$, $HCO_3$ or amino acid anions in an amount sufficient to stabilize any complex formed between the ammonia or volatile amine and the polyvalent metal ions.

As noted above, the compositions hereof are aqueous liquid materials and, as such, water (employed as a solvent or carrier medium) will constitute a substantial portion of the carpet or upholstery shampoo composition of interest. Typically, from about 50 to about 98 (preferably from about 50 to about 90) parts by weight of water will be employed per 100 parts by weight of the indicated shampoo formulation.

As in the case of conventional liquid carpet shampoo formulations, the compositions hereof can further contain one or more of the usual optional ingredients as desired including, for example, foam builders or stabilizers such as amine oxide surfactants, alkanolamides, alkyl amines, amphoteric cycloimidines or imidazolines; optical brighteners; perfumes; antistatic agents; and the like.

Preparation or formulation of the above-described carpet or upholstery shampoo formulations presents no special obstacles or problems to be overcome and can thus be conveniently accomplished in accordance with mixing/formulation techniques and procedures already quite well known to those skilled in this art.

Use of the compositions hereof for carpet or upholstery cleaning purposes is also accomplished in the usual or customary fashion, namely by applying the liquid detergent composition to the soiled carpet or upholstered article; allowing the detergent composition to dry upon said carpet or upholstered article, thereby forming a solid, non-tacky film or powdery residue thereon; and removing at least a portion of said solid film or residue from said carpet or upholstered article by vacuuming.

Typically, carpet or upholstery shampoo formulations used in the foregoing fashion are applied at a total solids content in the range of from about 0.1 to about 10 (preferably from about 1 to about 4) weight percent on a total composition weight basis. Thus, in those instances where the compositions hereof are manufactured and marketed at higher solids contents (e.g., as dilutable concentrates), they will typically be diluted to within the above-stated normal end-use solids content range prior to being employed in the actual cleaning process of interest.

The present invention is further illustrated and understood by reference to the following examples thereof in which all parts and percentages are on a weight basis unless otherwise indicated.

EXAMPLES 1 AND 2

In these examples, carpet shampoo compositions are prepared containing (on an active solids basis) 10 weight percent of a higher alkyl glucoside surfactant, 10 weight percent of a water dispersible acrylic polymer composition ("Primapel" C-93 carboxylated acrylic polymer from Rhom and Haas) and about 80 weight percent (on a total composition weight basis) of water.

The alkyl glycoside surfactant employed in the Example 1 formulation is a $C_{12-13}$ alkyl polyglucoside having an average degree of polymerization (D.P.) of about 2.2 to about 2.8 (APG-23-3).

The alkyl glucoside surfactant employed in the Example 2 formulation is a $C_{9-11}$ alkyl glucoside composition having an average D.P. of about 1.3 (APG-91-1).

The resulting formulations are then evaluated as to their carpet cleaning performance in terms of their Cleaning Effectiveness, Resoiling Resistance, Foam Height (Initial and After 10 Minutes) and in terms of the nature of the residue left thereby upon drying.

Cleaning Effectiveness and Resoiling Resistance Characteristics are determined using the shampoo formulation of interest at (i.e., diluted to) a 2 weight % solids level as follows:

A pre-cut beige color carpet piece (24.5"×7.5") is fixed into a gallon ball mill. The carpet piece is soiled with 5 grams of a synthetic soil mixture composed of 38% peat moss, 17% cement, 17% Kaolin clay, 17% silica, 1% red Iron Oxide and 10% charcoal using 15-1" and 15-½" carborundum balls by running the ball mill at 60 rpm forward for 5 minutes and then in reverse for 5 minutes at 60 rpm. The carpet is shaken to remove loose dirt and then a section of 7-1/6"×7-½" is scrubbed with a brush with 12 ml of the 2% solids content shampoo composition of interest. The carpet is dried overnight at room temperature and vacuumed and is visually inspected and rated as to cleanliness by a panel of four persons, each of which applied or assigned a rating from one to three (a rating of three being the best or most desirable). The individual ratings are then totaled and are set forth in Table A below, with "4" being the worst possible rating and "12" being the best.

The carpet sample is then resoiled in the ball mill and is then visually inspected and rated as to resoiling resistance with 3 (12 total) indicating best resoiling resistance and with 1 (4 total) being the worst.

Foam height is also determined using the formulations at 2 weight percent solids and is measured as follows:

A 150 ml of use-diluted (2% solids) shampoo composition sample is agitated in a Hamilton Beach blender for 15 sec. The foam height is measured after transferring into 1000 ml graduated cylinder. The foam height is also measured after standing undisturbed for 10 minutes.

Evaluation of the nature or character of the residue left upon drying of the various shampoo formulations is accomplished using said shampoo formulations in undiluted, as-prepared form (i.e., at 20 weight % solids) as follows:

Samples of the various shampoo formulations (as prepared at 20 weight percent solids) are evaporated at 110° F. (43.3° C.) for 24 hours. The resulting residue is then permitted to cool to room temperature, is examined and is rated as to its character (e.g., tacky, non-tacky, powder, brittle film, etc.)

The results of these various evaluations are summarized in Table A below.

For comparative purposes similar testing is conducted using conventional formulations containing sodium lauryl sulfate (SLS) or alpha-olefin sulfonate (AOS) in place of the above-identified glycoside surfactant components. Results of these tests indicate that the glycoside-based compositions have cleaning and resoiling characteristics which are at least comparable to those of the conventional anionic surfactant-based formulations.

TABLE A

| RUN NUMBER | SURFACTANT | CLEANING PERFORMANCE | RESOILING RESISTANCE | FOAM HEIGHT INITIAL (mm) | FOAM HEIGHT 10 MINUTES (mm) | CHARACTER OF RESIDUE |
|---|---|---|---|---|---|---|
| Example 1 | APG-23-3 | 9.5 | 8.0 | 700 | 550 | non-tacky & powdery |
| Example 2 | APG-91-1 | N.D.[1] | N.D.[1] | 860 | 740 | non-tacky & powdery |

[1]N.D. = not determined

While the present invention has been described and illustrated by reference to certain specific embodiments and examples thereof, such is not to be interpreted as in any way limiting the scope of the instantly claimed invention. Further, while the invention is disclosed herein in terms of normally solid, water soluble or dispersible polymer-containing carpet and upholstery shampoo compositions which are adapted for use by applying in aqueous liquid form, drying to form a solid, soil-containing film or powdery residue and vacuuming to remove said film or residue, it is nonetheless contemplated that those skilled in the art will readily understand that glycoside surfactants of the sort described herein can also be suitably employed in other types or forms of carpet or upholstery cleaning methods and products. Examples of such other products include "steam cleaning" compositions which are composed predominantly of surfactant and water and which are employed in a flush-and-extract procedure [i.e., in which a hot (e.g., about 130° F.) aqueous surfactant is briefly flushed on the carpet (thereby raising dirt to the surface) and the dirt-containing aqueous solution is quickly vacuumed up by a vacuuming section associated with the solution applicator head] as well as powdered absorbent products of the type employing surfactants in conjunction with organic solvent-saturated filler (i.e., powdery absorbent carrier) materials such as sawdust, wood flour, diatomaceous earth, etc.

What is claimed is:

1. A liquid detergent composition suitable for use as a carpet shampoo and/or as an upholstery cleaning formulation, said composition comprising:

a. from about 1 to about 50 parts by weight of a surfactant ingredient which comprises, on a surfactant ingredient weight basis, from about 5 to about 70 weight percent of a glycoside surfactant and from about 30 to about 95 weight percent of an anionic surfactant;

b. from about 1 to about 50 parts by weight of a normally solid water soluble or water dispersible addition polymer selected from the group consisting of styrene/maleic anhydride copolymers and neutralized or partially esterified derivatives thereof; and c. from about 50 to about 98 parts by weight of water.

2. A liquid detergent composition suitable for use as a carpet shampoo and/or as an upholstery cleaning formulation, said composition comprising:

A. from about 1 to about 50 parts by weight of a surfactant ingredient consisting essentially of one or more glycoside surfactants;

B. from about 1 to about 50 parts by weight of a low molecular weight water soluble or water dispersible acrylic addition polymer consisting essentially of copolymerized units of (a) butyl acrylate, (b) styrene, (c) methyl methacrylate, and (d) an acid monomer selected from the group consisting of methacrylic acid, acrylic acid, itaconic acid and any mixture of two or more thereof, in the ratio by weight of a/b/c/d of 20–60/0–25/0–15/40–62; the polymer having a number average molecular weight of from about 2,500 to 100,000 and a pka of less than about 6.7 and containing a maximum of about 1 part by weight styrene per part by weight of butyl acrylate; and C. from about 50 to about 98 parts by weight of water.

3. The composition of claim 2 wherein said composition comprises:

a. from about 5 to about 25 parts by weight of the surfactant ingredient;

b. from about 5 to about 25 parts by weight of the water soluble or dispersible addition polymer; and c. from about 50 to about 90 parts by weight of water.

4. The composition of claim 2 which further comprises at least about 0.8 equivalents of polyvalent metal ion per equivalent of carboxyl groups in the addition polymer; ammonia or a volatile amine in an amount effective to solubilize the addition polymer; and $CO_3^{--}$, $HCO_3$ or amino acid anions in an amount sufficient to stabilize any complex formed between the ammonia or volatile amine and the polyvalent metal ions.

5. A method of cleaning a soiled carpet or upholstered article, said method comprising the steps of:

a. applying the liquid detergent composition of claim 4 to said soiled carpet or upholstered article;

b. allowing the so-applied detergent composition to dry upon said carpet or upholstered article, thereby forming a solid friable film or powdery residue thereon; and c. removing at least a portion of said solid, friable film or powdery residue from said carpet or upholstered article by vacuuming.

* * * * *